US005823545A

United States Patent [19]

Goeckel

[11] Patent Number: 5,823,545

[45] Date of Patent: Oct. 20, 1998

[54] ROLLER SKATE CHASSIS

[76] Inventor: Gregory W. Goeckel, 1839 Sherwood Dr., Defiance, Ohio 43512

[21] Appl. No.: 938,109

[22] Filed: Sep. 26, 1997

Related U.S. Application Data

[63] Continuation of Ser. No. 539,185, Oct. 4, 1995, abandoned.

[51] Int. Cl.[6] ..... A63C 17/04

[52] U.S. Cl. ..... 280/11.22; 280/11.27; 280/11.28

[58] Field of Search ..... 280/11.22, 11.27, 280/11.28, 79.11; 301/112, 121, 132

[56] References Cited

U.S. PATENT DOCUMENTS

| | | | |
|---|---|---|---|
| 3,963,252 | 6/1976 | Carlson | 280/11.22 |
| 4,125,273 | 11/1978 | Rothmayer | 280/603 |
| 4,578,835 | 4/1986 | Pichler et al. | 7/168 |
| 4,645,223 | 2/1987 | Grossman | 280/11.28 |
| 4,711,458 | 12/1987 | Shim | 280/11.22 |
| 5,048,848 | 9/1991 | Olsen et al. | 280/11.22 |
| 5,505,470 | 4/1996 | Hoshizaki | 280/11.22 |
| 5,591,509 | 1/1997 | Lorenz et al. | 428/107 |
| 5,595,392 | 1/1997 | Casillas | 280/11.27 |
| 5,649,717 | 7/1997 | Augustine et al. | 280/610 |
| 5,695,209 | 12/1997 | Debord et al. | 280/610 |

FOREIGN PATENT DOCUMENTS

| | | | |
|---|---|---|---|
| 29137 | 2/1911 | United Kingdom | 280/11.22 |

*Primary Examiner*—Brian L. Johnson
*Assistant Examiner*—Bridget Avery
*Attorney, Agent, or Firm*—Leydig, Voit & Mayer, Ltd.

[57] ABSTRACT

An improved inline skate chassis having a downwardly opening wheel slot extending longitudinally of the chassis. A plurality of downwardly open spaced apart axle slots extend transversely of the wheel slot. A plurality of wheels are mounted on axles with opposite ends. A pair of wheel mounts for each wheel is positioned on the axle adjacent the opposite axle ends, respectively. The wheel mounts are removably secured in the axle slots with the wheels in the wheel slot whereby each of the wheels may be reversed, replaced or changed in position as desired during use.

26 Claims, 9 Drawing Sheets

ROLLER SKATE CHASSIS

This application is a continuation of U.S. application Ser. No. 08/539,185, filed Oct. 4, 1995, now abandoned.

BACKGROUND OF THE INVENTION

The present invention relates to roller blade chassis, and more particularly to an improved roller blade chassis by which the wheels may be more easily interchanged, rotated or replaced.

Roller blades or inline skates have become very popular. Both amateur and professional skaters use roller blade skates. Newly formed are roller blade hockey leagues. Professional roller blade hockey is now being played at many locations throughout the United States.

Well known to inline skaters is the fact that different wheels work better on different surfaces. It is also well known that the wheels of an inline skate wear out. Thus, it is highly desirable to provide an improved chassis for an inline skate. It is also highly desirable to provide an improved inline skate chassis by which the wheels may be replaced as desired.

Inline skaters also know that the toe and heel wheels of an inline skate wear out faster than the middle two wheels. Therefore it is highly desirable to provide an improved inline skate chassis which allows the toe and the heel wheels to be rotated with the middle wheels to provide for even wheel wearage during use of the inline skate. It is also highly desirable to provide an improved inline skate chassis by which each of the wheels of the chassis independently of the other wheels of the chassis may be interchanged with different wheels when desirable or when worn or otherwise needing replacement.

Inline skaters also know that the inline skate wheels wear faster on the outside than on the inside. It is therefore highly desirable to provide an improved inline skate chassis by which the wheels may be rotated inside to outside as desired to provide for even wheel wearage.

Inline skaters have also found it desirable to provide an improved inline skate chassis in which wheels of different sizes can be mounted and used. It is also highly desirable to provide an improved inline skate chassis by which the bushings of the wheel may be mounted in different positions such that the wheels can be mounted on the chassis at different heights.

It is therefore highly desirable to provide an improved inline skate chassis which may be manufactured relatively easily and inexpensively and allows the wheels to be interchanged, rotated or replaced in highly a convenient manner. Finally, it is highly desirable to provide an improved inline skate chassis having all of the above features.

SUMMARY OF THE INVENTION

It is therefore an object of the invention to provide an improved chassis for an inline skate.

It is also an object of the invention to provide an improved inline skate chassis by which the wheels may be replaced as desired.

It is also an object of the invention to provide an improved inline skate chassis which allows the toe and the heel wheels to be rotated with the middle wheels to provide for even wheel wearage during use of the inline skate.

It is also an object of the invention to provide an improved inline skate chassis by which each of the wheels of the chassis independently of the other wheels of the chassis may be interchanged with different wheels when desirable or when worn or otherwise needing replacement.

It is also an object of the invention to provide an improved inline skate chassis by which the wheels may be rotated inside to outside as desired to provide for even wheel wearage.

It is also an object of the invention to provide an improved inline skate chassis by which the bushings of the wheel may be mounted in different positions such that the wheels can be mounted on the chassis at different heights.

It is also an object of the invention to provide an improved inline skate chassis which may be manufactured relatively easily and inexpensively and allows the wheels to be interchanged, rotated or replaced in a highly convenient manner.

It is finally an object of the invention to provide an improved inline skate chassis having all of the above features.

In the broader aspects of the invention there is provided an improved inline skate chassis having a downwardly opening wheel slot extending longitudinally of the chassis. A plurality of downwardly open spaced apart axle slots extend transversely of the wheel slot. A plurality of wheels are mounted on axles with opposite ends. A pair of wheel mounts for each wheel is positioned on the axle adjacent the opposite axle ends, respectively. The wheel mounts are removably secured in the axle slots with the wheels in the wheel slot whereby each of the wheels may be reversed, replaced or changed in position as desired during use.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
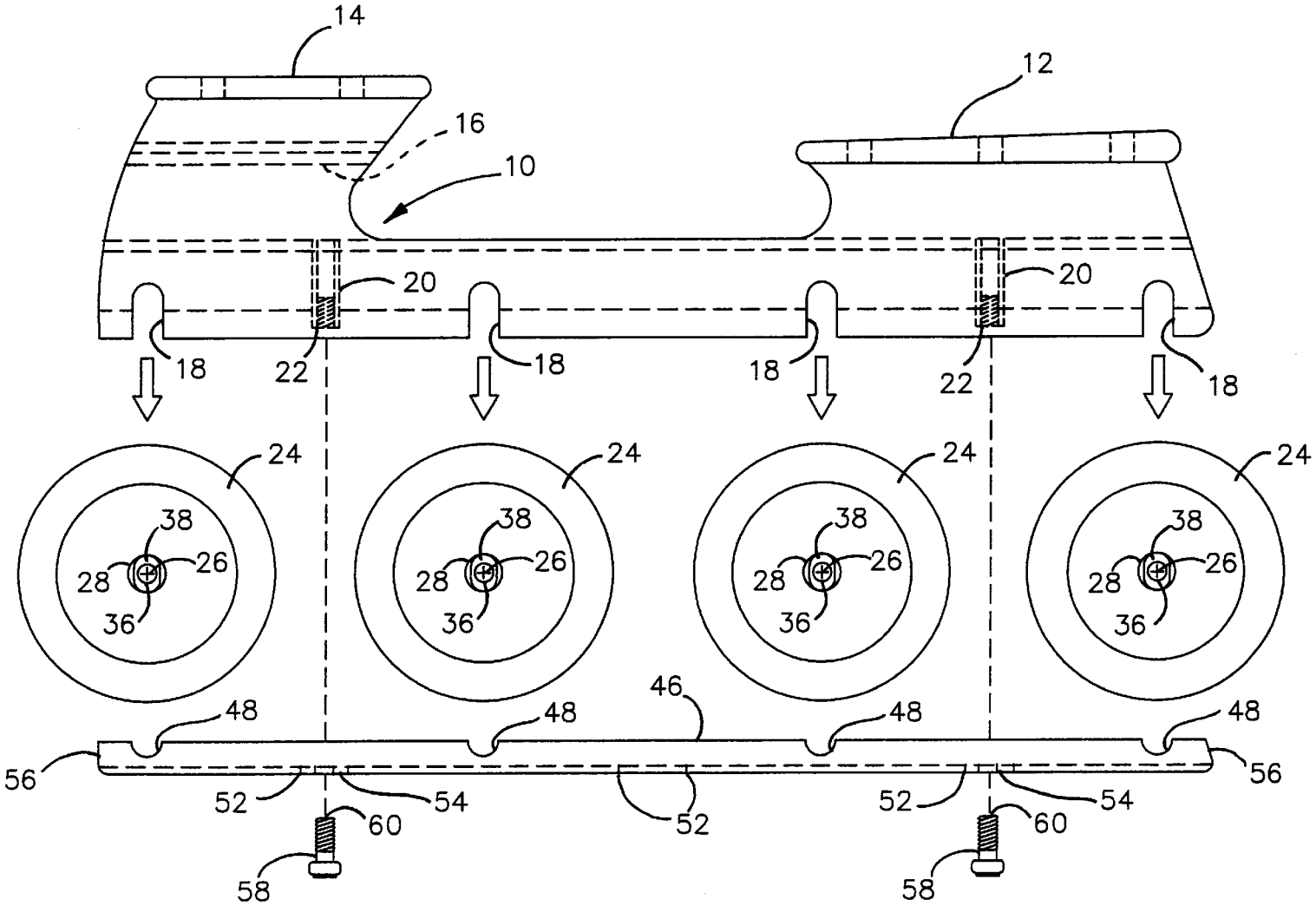
FIG. 1 is an exploded side view of the improved inline skate chassis of the invention with the wheels and body bar exploded from the chassis.
Figure 2:
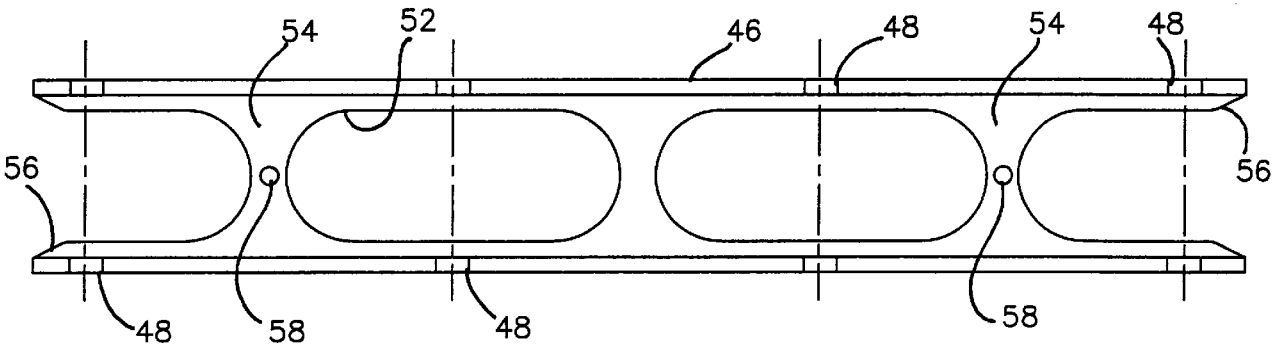
FIG. 2 is a top plan view of the bottom bar of the chassis shown in FIG. 1.
Figure 3:
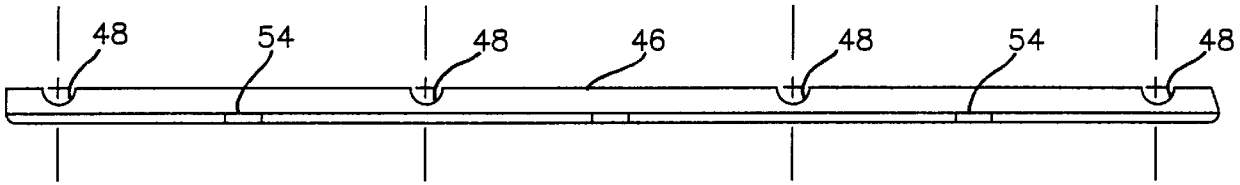
FIG. 3 is a side view of the bottom bar of the chassis shown in FIG. 1.
Figure 4:
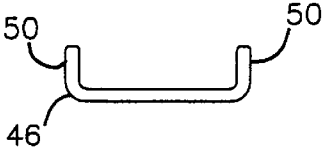
FIG. 4 is an end view of the bottom bar of the chassis shown in FIG. 1.

Referring to FIGS. 1-8, there is shown the improved inline skate chassis 10 of the invention to include a toe mount 12 and a heel mount 14. The chassis 10 has a downwardly opening wheel slot 16 extending longitudinally of the chassis 10 essentially the entire length thereof. At spaced apart locations, the chassis has a plurality of downwardly opening axle slots 18 extending transversely of the wheel slot 16. In the specific embodiment illustrated, there is a single wheel slot, and four spaced apart axle slots.

In specific embodiments, the chassis 10 can be molded, cast or extruded of sufficiently strong plastic material or metal, or can be made of bent, cut and welded sheet steel as desired.

In the chassis 10 shown in FIG. 1, an anchor rib 20 is positioned within the wheel slot 16 between at least the fore and aft pair of axle slots 18 to depend downwardly between the axle slots. These fastening ribs 20 are provided with a threaded hole 22 therein for purpose which will be described hereinafter.

Figure 5:
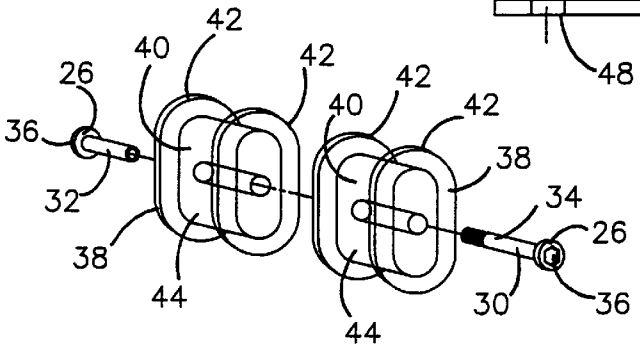
FIG. 5 is an exploded enlarged view of the wheel mounts of the inline skate chassis shown in FIG. 1.
Figure 6:
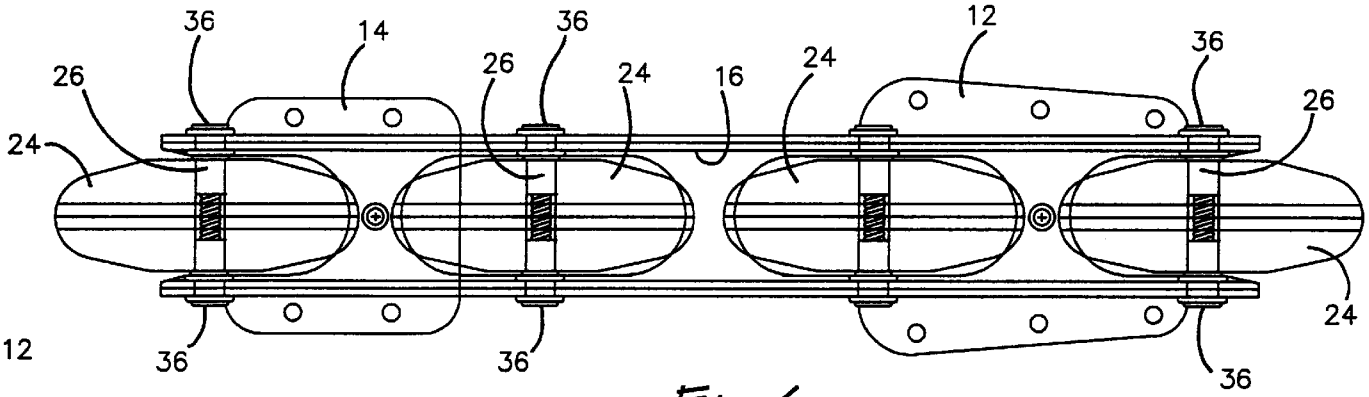
FIG. 6 is a top planar view of the chassis shown in FIG. 1.
Figure 8:
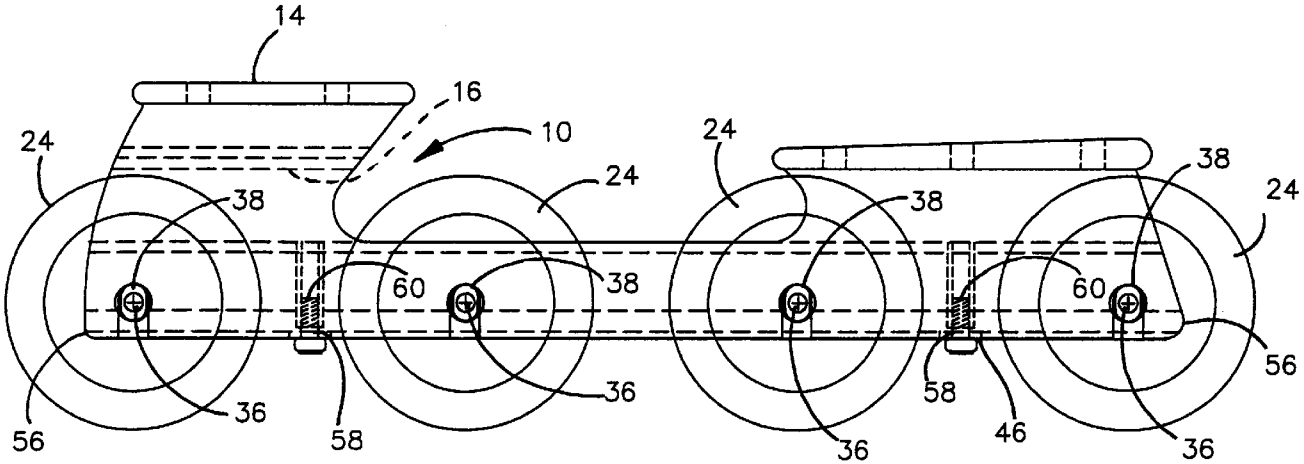
FIG. 8 is a side view of the chassis shown in FIG. 1 fully assembled.
Figure 7:
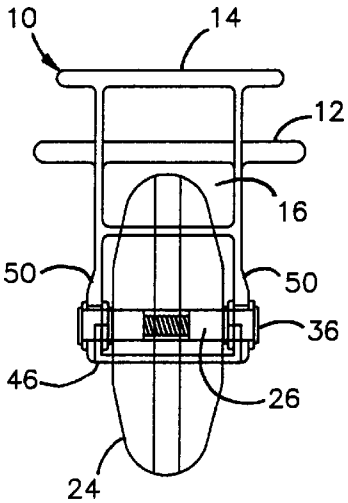
FIG. 7 is an end view of the chassis shown in FIG. 1.

Referring to FIG. 5, each of the wheels 24 are mounted on an axle bolt 26 which extends through the centrally located bushing 28 in each wheel. Wheels 24 are in all ways conventional. Each of the wheels 24 are provided with an axle hole and bushing 28. Axle bolt 26 is in a specific embodiment provided in two pieces, a male piece 30 and a female piece 32. When pieces 30 and 32 are joined by the threads provided, axle bolt 26 provides a constant diameter shaft 34 extending between spaced apart enlarged heads 36. Mounted on axle bolt 26 are a pair of wheel mounts 38 adjacent to heads 36 with the wheel 24 therebetween.

Wheel mounts 38 each have a centrally located boss 40 and a pair of enlarged flanges 42 secured to opposite ends of the boss 40. Thus, boss 40 separates the flanges 42 to form a chassis groove 44 between the flanges 42. Boss 40 is shaped in all embodiments to be complementary to the axle slots 18. The flanges 42 may be similarly shaped, but larger than boss 40 such that when the boss 40 is within the axle slots 18, the flanges 42 are on opposite sides of the chassis wall which forms the wheels slots 16, as will be explained in more detail later. Thus by the wheel mounts 38, each of the wheels 24 can be removably secured to the chassis by positioning boss 40 of the wheel mounts 38 in the axles slots 18 and the wheels 24 in the wheels slots 16. In all of the embodiments of the chassis 10, the wheel units are unconnected and each of the wheels may be positioned in its own respective axle slot 18 or removed therefrom by dropping the entire wheel 24 and wheel mount 38 assembly downwardly of the chassis. See FIGS. 11, 17, 21 and 22, also.

To hold the wheel mounts 38 within the chassis axle slots 16 a bottom bar 46 is provided in those versions of the chassis 10 of the invention shown in FIGS. 1–12. Still referring to FIG. 1, bottom bar 46 is connected to latched to the chassis 10 to close both the wheel slots 16 and the axle slots 18. Bottom bar 46 has spaced apart axle bottom portions 48 which when bottom bar 46 is secured to chassis 10, forms the bottom of axle slot 18, closes axle slot 18, and provides axle slot 18 with a shape which is complementary to the boss 40 of the wheel mounts 38. Bottom bar 46 also has spaced apart wheel openings 52 which are defined by spaced apart cross members 54 and opposite ends 56 of bottom bar 46. Within cross bars 54 are screw holes 58 for positioning of screws 60 to engage or latch the threads of threaded hole 22 and ribs 20 afore-mentioned.

Referring to FIGS. 2–9 a modified version of the chassis 10 is shown having bottom bar 46 provided in two pieces each of which are pivotally connected to the chassis at point 66 and 68 both between the center wheels 24. Otherwise chassis 10 and bottom bars 62, 64 are the same as chassis 10 afore-described and bottom 46. Bottom bars 62, 64 are secured to chassis 10 by a latch or screw 60 as above described. In another modified version of chassis 10 not shown, bottom bars 62, 64 are pivoted to chassis 10 fore and aft of wheels 24.

Referring to FIGS. 2–8, and 10–12, a third modified version of chassis 10 is shown. In this modification, bottom bar 46 is pivoted to chassis 10 at position 70 ahead of fore wheel 24 and locked to chassis 10 aft of rear wheel 24 by a detent or latch 72. In this version, detent 72 has a detent opening 74 in chassis 10 above and rearward of axle 26 of aft wheel 24. Bottom bar 46 has a detent button 76 which can be depressed to hold bottom bar 46 in closed position 70 with detent button 76 at rest in detent opening 74 thus locking bottom bar 46 in position 70 closing wheel slot 16 and axle slots 18 and to hold wheel mounts 38 in axle slots 18 as above described. As illustrated in FIGS. 2–8, 10 and 11 this embodiment is no different than the first embodiment shown in FIGS. 1–8 except for the elimination of the ribs 20, holes 24 and screws 60, attachment of the bottom frame member 46, and the elevated chassis 10 adjacent the aft end of chassis 10 to elevate the detent 72 above the axle 26 of the aft wheel 24 of the chassis.

Referring to FIGS. 2–8, and 13–15 a fourth modification of the chassis 10 is shown to comprise the substitution of a pair of latch pins 80 for the bottom bar 46. Chassis 10 in this version has a bore 82 drilled through both chassis side portions 50 adjacent the bottom and extending the entire length of chassis 10. Pins 80 fit within respective bores 82 and are locked therein by a latch or detent 72 which in all respects is similar to the detent 72 afore-described. Detent opening 74 however in this modification is coaxial with bore 82. Pins 80 extend across each axle slot 16 closing the same, and providing a support on which the wheel mounts 38 rest and by which wheel mounts 38 are held in axle slots 16.

Referring to FIGS. 2–8, and 16–22, there is shown three modified versions of the chassis 10 which require no bottom bar 46 whatsoever. In the first version illustrated in FIGS. 2–8, and 16–18, each of the wheel mounts 38 are provided with a latch or detent 86 mounted on a flexible and resilient arm 88. In this embodiment, chassis 10 has a detent opening spaced from the axle slot generally directly above the axle slot and spaced from the axle slot 16 the same distance as latch or detent 86 is spaced from the axle slot 16. Thus, each of the wheel mounts can be slid into a respective axle slot and the detent 86 positioned in the latch or detent opening 90 in the chassis 10 as shown thereby securing each wheel to the chassis 10.

Figure 17:
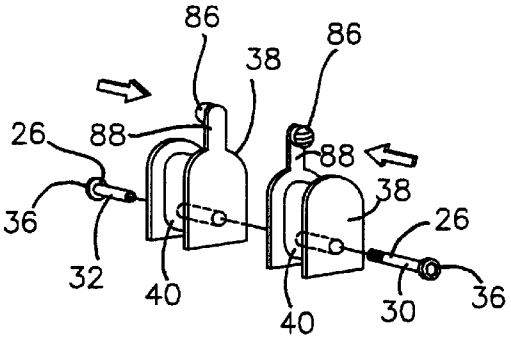
FIG. 17 is an exploded enlarged view of the wheel mounts of the inline skate chassis version with the wheel lock of the invention attached shown in FIG. 16.

The second version is that shown in FIGS. 2–8, 19 and 20 in which each of the axle slots 18 have latch openings 92 which are smaller than the slot spaced from the opening. In FIG. 17 each of the axle slots 18 are shown to be generally triangular in shape, with the latch openings 92 sufficiently large to pass axles 26 through the latch opening 92. In this embodiment, wheel mounts 38 are also generally triangular in shape. Bosses 40 are complementary to axle slots 18 and are positioned in the axle slots 18. In this modification, however, the wheel mounts 38 have only an exterior flange 42 as wheel mounts must be moved axially outwardly away from the chassis to drop the axle 26 through the latch opening 92 of the axle slots 16 to remove the wheels 24 from the chassis 10. See FIG. 19. The wheel mounts 38 are positioned within and removed from the axle slots 18 by tightening and loosening respectively the male piece 30 and female piece 32 of the axle 26 so as to urge the wheel mounts together and apart and into and out of the axle slots 18, axially of axle 26, respectively. When held in position by the enlarged heads 36 of the axle 26, the wheel mounts cannot move downwardly as afore-described because they have a size larger than the latch openings 92, thus securing the wheels 24 in the axle slots 18 without the necessity of a bottom member.

Figure 11:
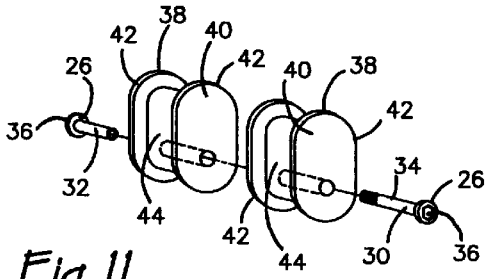
FIG. 11 is an exploded enlarged view of the wheel mounts of the inline skate chassis version shown in FIG. 10.
Figure 12:
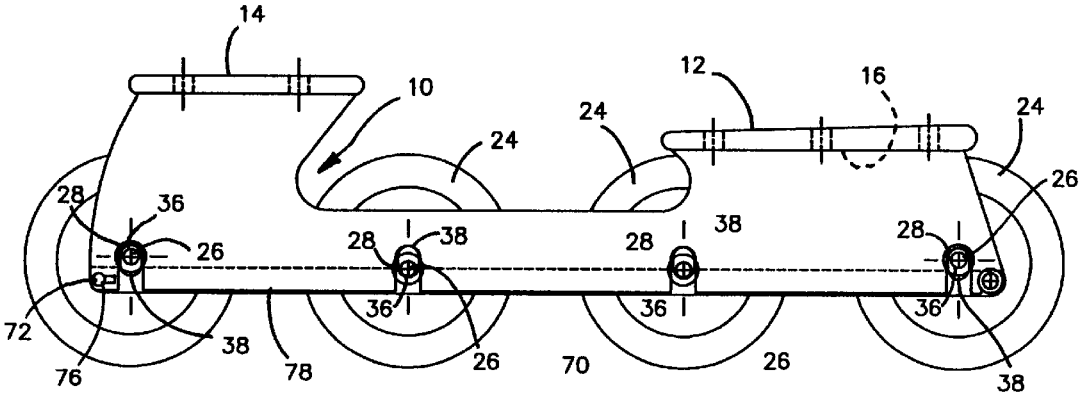
FIG. 12 is a side view of the inline skate chassis shown in FIG. 10 in assembled condition.
Figure 20:
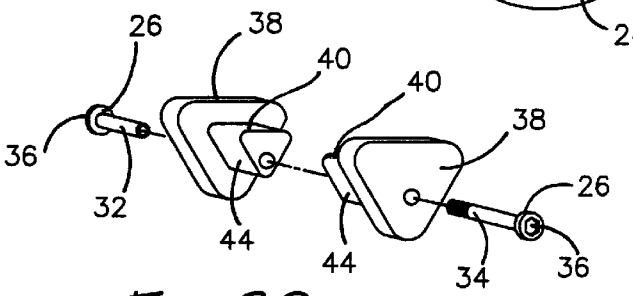
FIG. 20 is an exploded enlarged view of the wheel mounts of the inline skate chassis version shown in FIG. 19.
Figure 21:
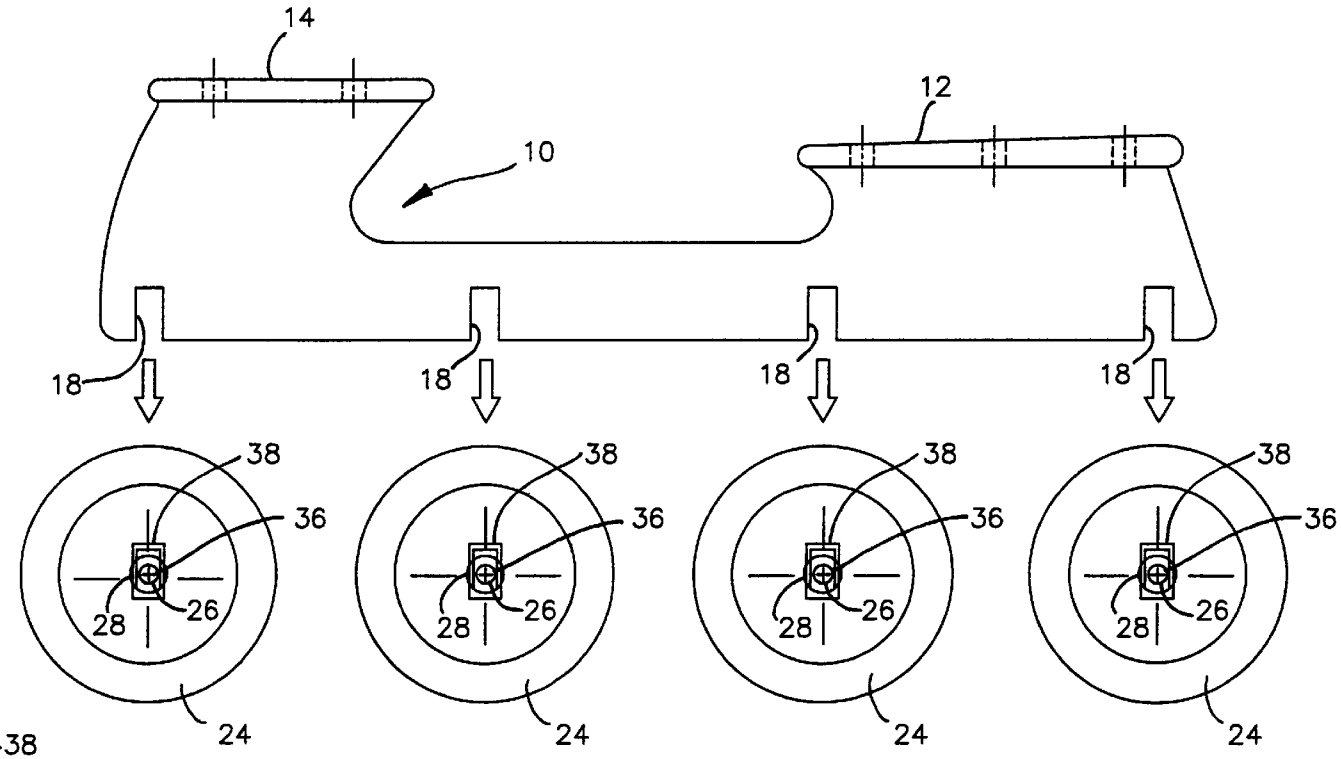
FIG. 21 is an exploded side view of yet another modified inline skate chassis of the invention, without the bottom bar of the chassis.
Figure 22:
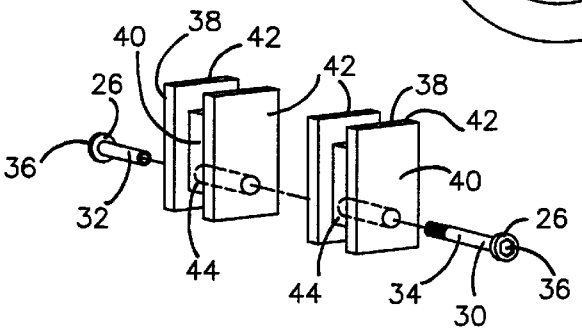
FIG. 22 is an exploded enlarged view of the wheel mounts of the inline skate chassis version shown in FIG. 21.

In the third version, wheel mounts 38 have parallel sides as shown in FIGS. 21 and 22 in a generally rectangular shape. While these wheel mounts 38 could be used with bottom bar variations 46, 62, 64 or pin 80 (not shown in FIG. 21), the generally rectangular or square wheel mounts 38 are shown held in place by a frictional latch which chassis 10 is squeezed between flanges 42 by tightening axle bolt 30, 32. In still other embodiments, wheel mounts 38 as shown in FIGS. 5, 11 and 20 may be held in axle slots 18 by friction, alone or by friction and a bottom bar 46, 62, 64 and their latches or latch pin 80, as desired, and the squeezing of the wheel mounts 38 together only seals the wheel mounts 38, axle 26 and bushing 28 together.

Figure 9:
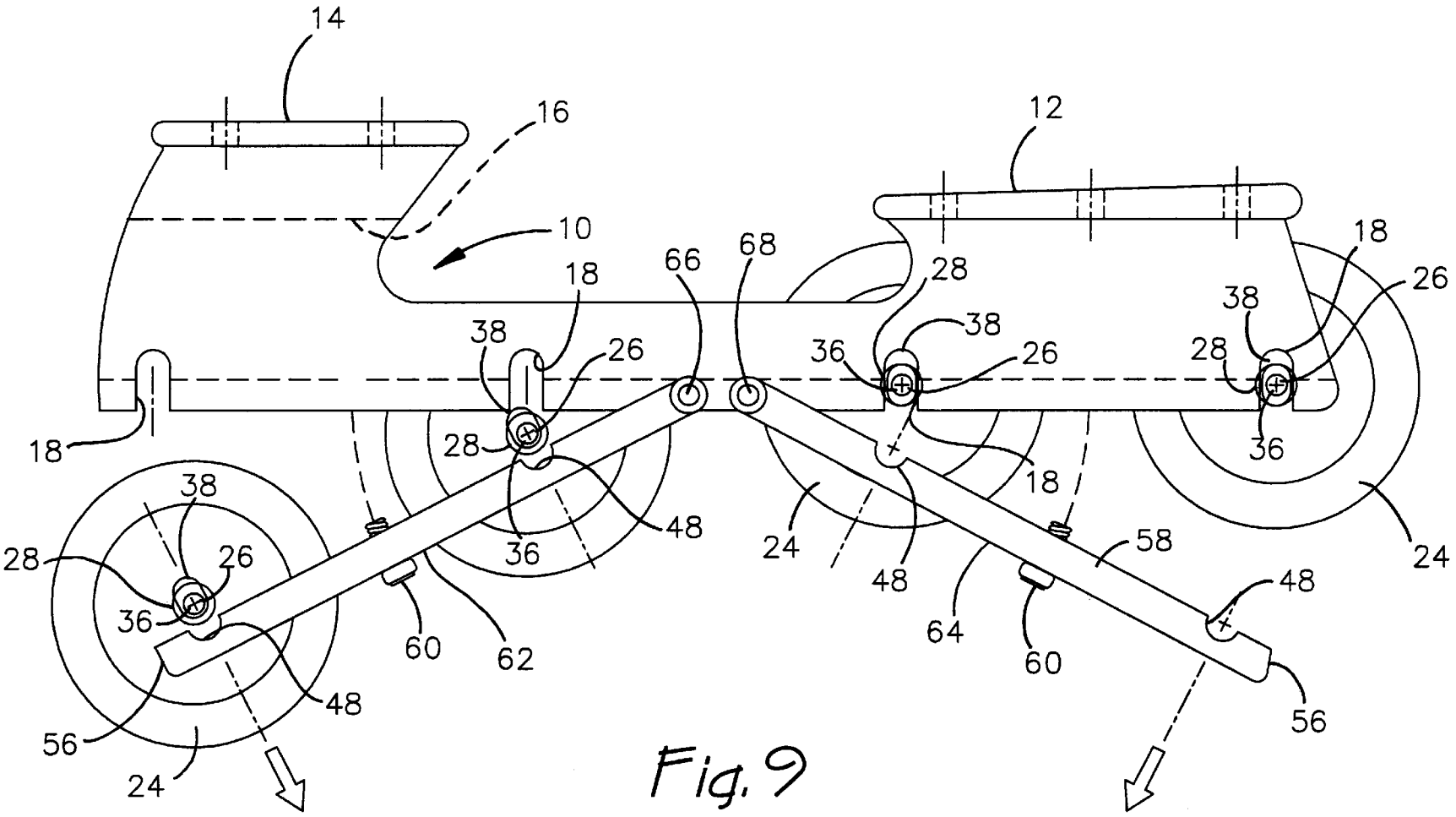
FIG. 9 is a partially exploded side view of the invention showing a modified inline skate chassis of the invention.
Figure 10:
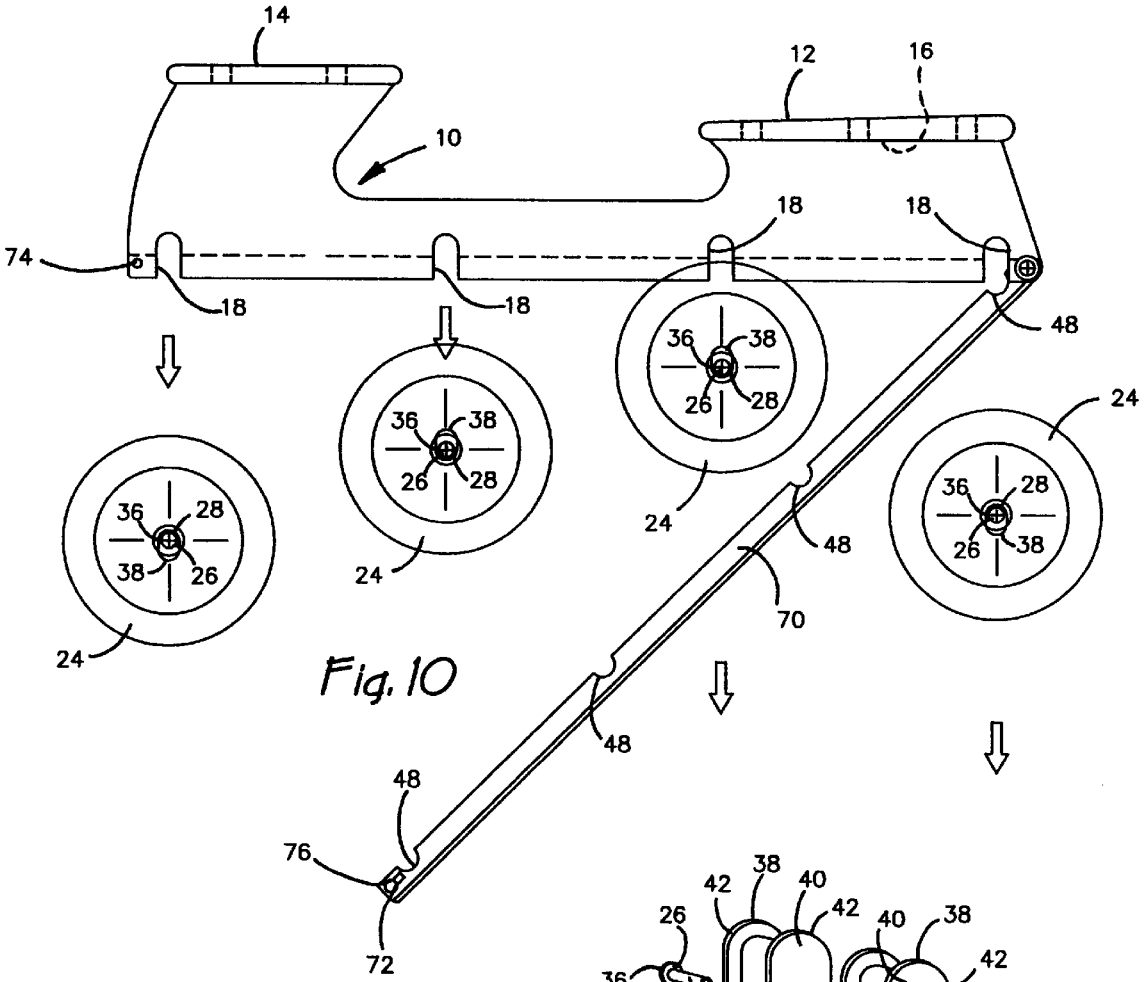
FIG. 10 is an exploded side view showing a modified version of the inline skate chassis of the invention.

Referring to FIGS. 1 and 9, there is shown wheel mounts 38 in which the axle 26 and the wheel mounts are coaxial. In FIGS. 9–15, wheel mounts 38 are elongated and the axes 26 and wheel mounts 38 are not coaxial. In FIGS. 9–15, axles 26 are adjacent one end and spaced from the other end. This allows the wheel units to be inserted into wheel slots in two distinct positions. In FIGS. 9–15, axles 26 may be positioned adjacent the upper end of the wheel mounts 38 and the wheels 24 may extend from the chassis 10 a minimum distance. In FIGS. 9–15, axles 26 may be adjacent the lower end of wheel mounts 38 as shown and the wheels 24 are extended from the chassis 10 a maximum distance.

The wheel mounts 38 of FIGS. 10–15 allow wheels 24 to be positioned to allow "rockering" with two of the wheels in their lowest position and two of the wheels in their highest position. "Rockering" is a term used by inline skaters to describe the action when skating on a chassis having the middle two wheels in their lowest or most extended position and the fore and aft wheels in their highest or retracted position.

Figure 19:
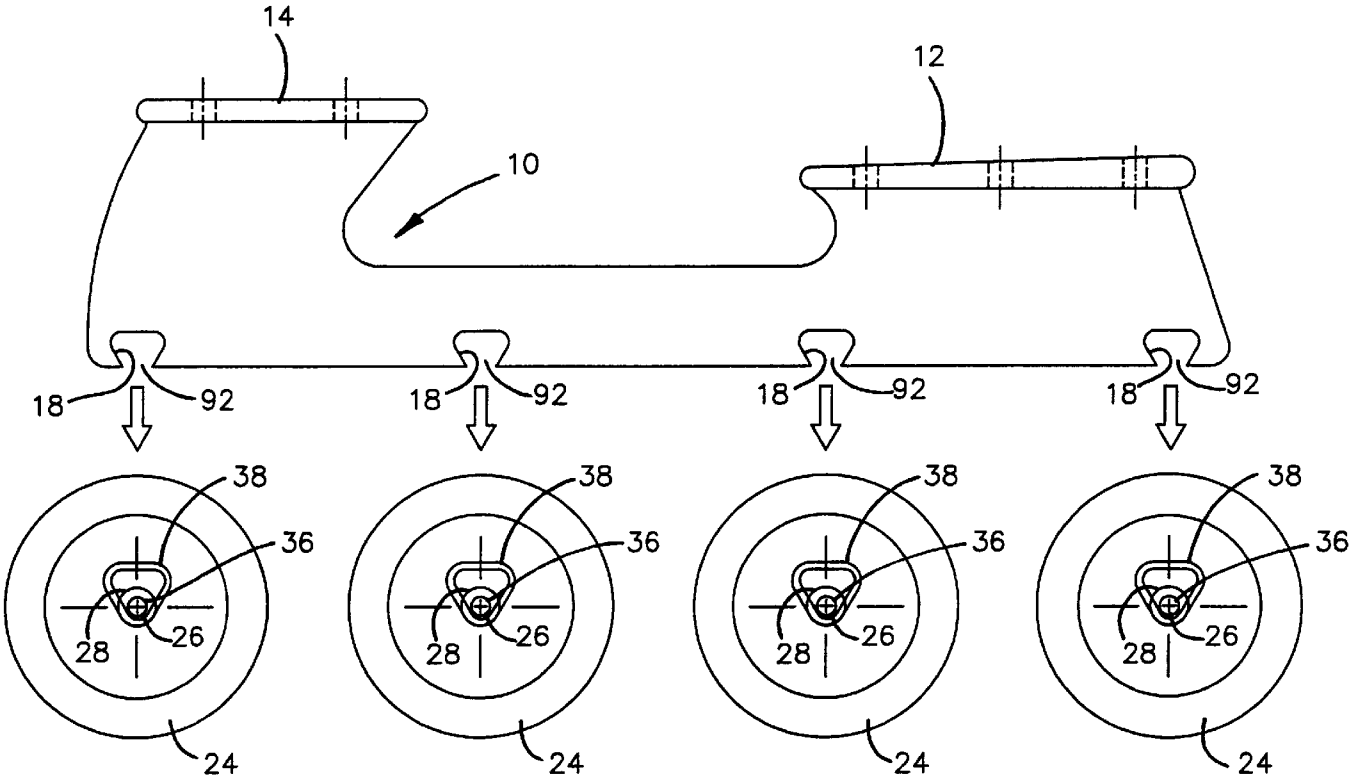
FIG. 19 is an exploded side view of yet another modified inline skate chassis of the invention.

Referring to FIGS. 19 and 21 wherein the wheel mounts are generally in a triangular and square or rectangular shapes, respectively, axles 26 are positioned adjacent one of the apexes or corners so to allow not only positioning the wheels 24 in a retracted and an extended position and to allow "rockering" as above described, but to allow the wheels to be moved fore and aft of a central position as shown in FIG. 19 and 21.

In all embodiments, the movement of the wheels fore and aft or up and down to accommodate "rockering" and/or other changes may be selected by the skater by positioning the wheel mounts 38 in the axle slots 16, selectively, prior to securing the same to the chassis 10.

In operation, the improved inline skate chassis 10 of the invention functions to allow each of the wheels 24 to be replaced with other wheels 24, repositioned with respect to both axial height and wheel position, rotated, exchanged with other wheels 24. The improved chassis 10 of the invention with the total flexibility as to the attachment of individual wheels 24 allows for the skater to adjust the axial height of the wheels 24 for "rockering", to rotate the wheels and to flip the wheels 24 in the same position to achieve maximum wear, and to change the wheels 24 with regard to different skating surfaces. All is possible with the improved chassis 10 of the invention without the use of tools.

With reference to FIGS. 1, 9, 12 and 18, the bottom bar 46 and/or wheel mounts 38 are lowered by releasing it latch, i.e. either depressing the detent 74, 86 or by loosening the screws 60 and lowering the bottom bars 46, 62, 64. In this position all four wheels 24 will drop out of the axle slots 18 in which they are positioned to be repositioned within the axle slots 18 as desired. If individual wheels 24 are to be replaced with other wheels 24 not being disturbed, the chassis 10 can be rotated 180° such that the axle slots 18 openings 92 face upwardly and individual wheels 24 can be replaced, rotated or exchanged as desired without disturbing the remaining wheels 24 which are held in the axle slots 18 by gravity. When all the wheels 24 are positioned as desired, the bottom bar is positioned in its at rest or closed position and the latch detent 74 is re-engaged or the latch screws 60 are tightened, and the inline skate is ready to use.

The axle slots 16 and the wheel mounts 38 as shown in FIGS. 1 and 9 provide each of the wheels 24 a total of two positions (1) as shown (2) reversed from that shown. The axle slots 16 and the elongated wheel mounts 38 as shown in FIGS. 10–15 have a total of four positions (1) retracted as shown (2) extended as shown (3) reversed retracted (4) reversed extended. The axle slots and wheel mounts 38 being generally triangular in shape as shown in FIGS. 19 and 20 have a total of six positions (1) retracted, forward (2) retracted, rearward (3) extended as shown (4) reversed retracted forward (5) reversed retracted rearward and (6) reverse extended. The axle slots 16 and wheel mounts 38 as shown in FIGS. 21 and 22 as being generally rectangular or square, similarly, have a total of four positions.

Figure 13:
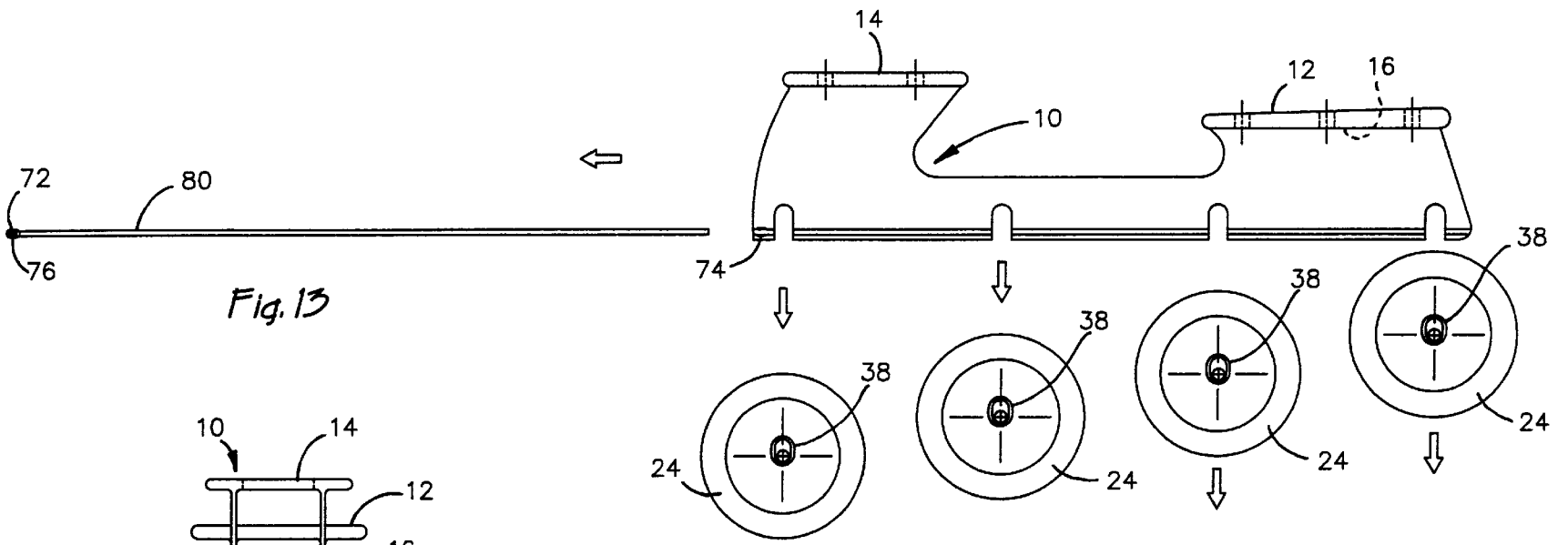
FIG. 13 is an exploded side view of a modified version of the inline skate chassis of the invention.
Figure 14:
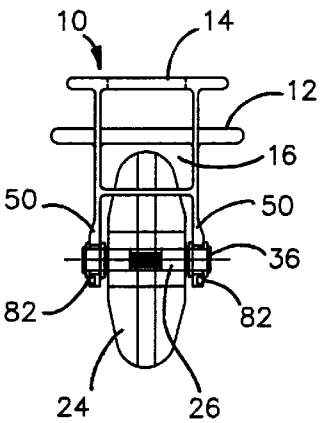
FIG. 14 is an end view of the chassis of FIG. 13.
Figure 15:
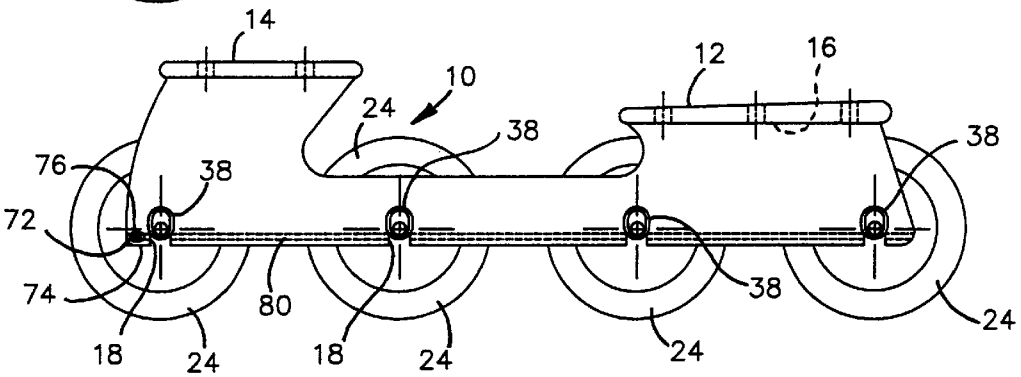
FIG. 15 is a side view of the inline skate chassis shown in FIG. 13, fully assembled.

Referring to FIGS. 13–15 there is shown the modified chassis 10 having bottom pins 80 which may be fully or partially removed from the chassis 10 by disengaging latch detent 74 from the chassis 10 and moving the pins 80 relative to the chassis 10 longitudinally thereof to open the axle slots 18 and to allow the wheel mounts 38 to drop from the chassis 10 as above described. If only a single wheel 24 needs to be removed from the axle slots 18, chassis may be rotated 180° to face the axle slots 18 upwardly and to remove the pins 80 so as to be able to remove each of the wheels 24 from the axle slots 18 selectively while the remaining wheels 24 are held within the axle slots by gravity. In this manner, the wheels 24 of the chassis 10 as shown may be selectively replaced, exchanged, rotated, or otherwise repositioned with regard to the chassis as needed. Once all the wheels 24 are located within the axle slot 16 as desired, latch pins 80 are reinserted in the chassis bore 82 and the latch detents are re-engaged with the chassis.

Figure 16:
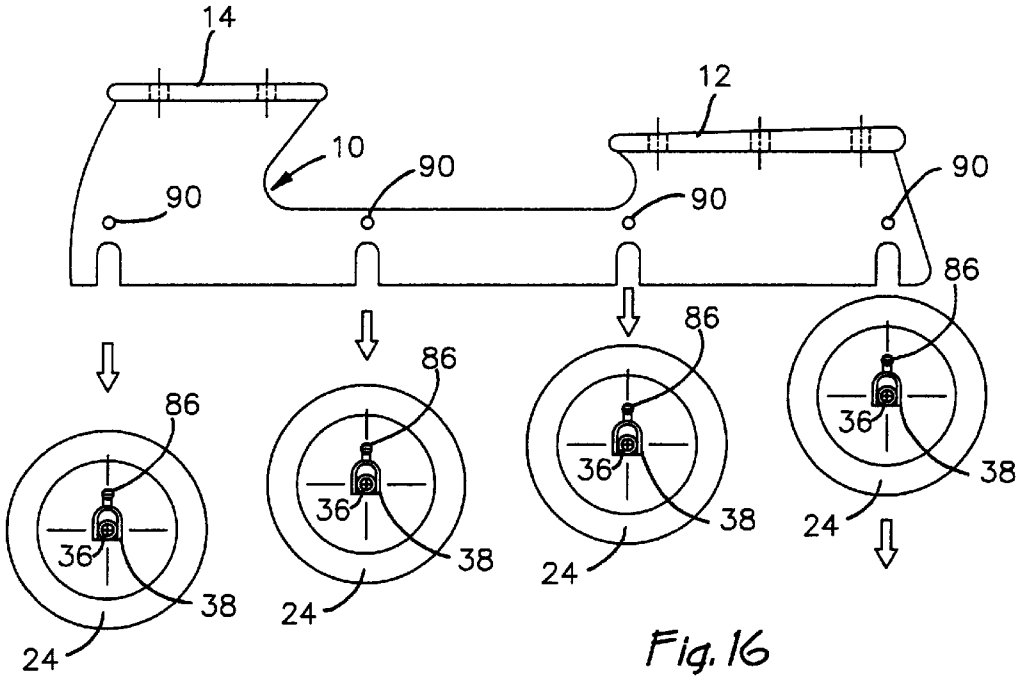
FIG. 16 is an exploded side view of a modified version of the inline skate chassis of the invention.
Figure 18:
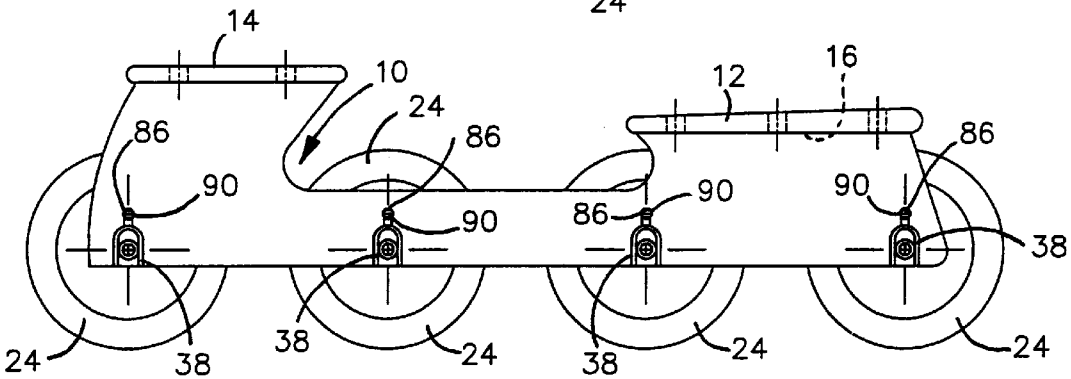
FIG. 18 is a side view of the inline skate chassis shown in FIG. 16 fully assembled.

With regard to FIGS. 16–18, chassis 10 and wheel mounts 38 are provided with latch detents 86 whereby each of the wheel mounts 38 are locked into position without the necessity of a bottom bar 46. In this embodiment, each of the wheels must be disengaged from the chassis 10 individually by depressing the detent 86 to disengage the detent 86 from the chassis opening 90 and to drop the wheel mount 38 from the chassis 10 through the axle slot 18 downwardly. In this manner each of the wheels 24 may be exchanged, replaced, or rotated as above described. In order to raise or lower the wheels 24 into their retracted and extended wheel positions above-described, the wheel mounts 38 must be exchanged for wheel mounts 38 having latch detents 86 with longer and shorter arms 88.

Referring to FIGS. 19 and 20, chassis 10 has axle slots 18 which do not have parallel side walls so as to accommodate generally triangular wheel mounts 38 as shown. In this embodiment, the wheel mounts 38 are removed from the axle slots 18 by disengaging the male 30 and female 32 axle pieces as above described and moving the axle pieces 30, 32 axially outwardly away from the chassis 10. Inside flange 42 has been removed to allow this movement. Wheel mounts 38 can be removed from the axle slots 18 and the axle 26 dropped downwardly through the opening of the axle slots 18 as above described. In this way, each of the wheels 24 may be individually replaced, exchanged, rotated and positioned as above described.

Referring to FIGS. 21 and 22, chassis 10 is shown to have axle slots 18 which have parallel sidewalls to accommodate generally rectangular and square wheel mounts 38 as shown. In this embodiment, the wheel mounts 38 can be removed from the axle slots 18 both by disengaging the male 30 and female 32 axle pieces as above described and moving the axle pieces 30, 32 axially outwardly away from the chassis 10 and by merely loosening the male 30 and female 32 axle pieces and dropping the wheel mounts 38 downwardly through the opening of the axle slots 18 so as to separate the same from the chassis 10. In both ways, each of the wheels 24 may be individually replaced, exchanged, rotated or positioned as above described. In this embodiment, as there are no bottom bars 46, 62, 64 or pins 80, the wheel mounts 38 are held in the wheel slots 18 totally by a frictional latch with the forces exerted upon the wheel mounts 38 by the male 30 and female 32 axle pieces to squeeze the chassis 10 therebetween.

In each of the chassis 10, wheels 24 may be exchanged on different chassis 10 by exchanging wheel mounts 38 separating male axle piece 30 from female axle piece 32 and wheel mounts 38 may be selectively exchanged by sliding the existing wheel mounts 38 and the wheel 24 from the axle 26. The selected wheel mounts 38 can then be positioned on axle 26 with the selected wheel 24 therebetween and the male and female axle pieces of the axle 26 reconnected as shown.

As above described, the improved chassis for an inline skate provides an improved chassis by which the wheels may be replaced in an inline skate, an improved chassis by which the wheels of the chassis may be interchanged with different wheels when desirable or when worn or otherwise needing replacement, an improved chassis in which the toe and the heel wheel may be rotated with the middle wheel to provide for even wheel wearage during use of the inline skate, an improved chassis by which the wheels may be rotated as desired to provide for even wheel wearage, an improved chassis by which the bushings of the wheel may be mounted off center such that the wheels can be mounted in the chassis at different heights, and an improved chassis which may be manufactured relatively inexpensively and is highly convenient to use.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A chassis assembly for an inline skate adapted to be mounted to a boot and to releasably secure a plurality of preassembled wheel and axle assemblies, the chassis assembly comprising:

an elongated channel member comprising a central portion adapted to be mounted to the boot and two flanges depending from the central portion and spaced to receive upper portions of a plurality of aligned wheels therebetween, the flanges comprising lower longitudinal edges having a plurality of longitudinally spaced opposing pairs of axle slots, each pair of opposing axle slots adapted to receive through hand-insertion opposite ends of an axle of one of the wheel and axle assemblies, at least one axle retention member adapted to be releasably mounted adjacent the lower edges of the flanges to selectively lock a plurality of the wheel and axle assemblies in respective pairs of axle slots, the retention member having a length sufficient to span a plurality of axle slots along the lower edges of the flanges and a width sufficient to span opposing pairs of axle slots, the retention member including a central portion adapted to allow free rotation of the wheels when the retention member is in position to lock the wheel and axle assemblies in the axle slots; and means for releasably securing the retention member to the channel mainline to lock a plurality of the wheel and axle assemblies in respective pairs of axle slots, the means being operable with human fingers without the need for any auxiliary tools.

2. The chassis assembly of claim 1 wherein the means for releasably securing the retention member to the channel member includes a hand operable screw.

3. The chassis assembly of claim 1 wherein the means for releasably securing the retention member to the channel member includes at least one detent on the retention member which engages a complementary detent opening on the channel member.

4. The chassis assembly of claim 1 wherein the retention member is pivotally connected to the channel member such that the retention member can pivot between an open position for the selective insertion and/or removal of the wheel and axle assemblies from respective pairs of axle slots and a closed position to wherein the retaining member locks a plurality of the wheel and axle assemblies in respective pairs of axle slots.

5. The chassis assembly of claim 4 wherein the means for releasably securing the retention member to the channel member includes a hand operable screw.

6. The chassis assembly of claim 4 wherein the means for releasably securing the retention member to the channel member includes at least one detent on the retention member which engages a complementary detent opening on the channel member.

7. The chassis assembly of claim of claim 1 wherein the retention member includes a pair of opposing upstanding flanges having a plurality of opposing longitudinally spaced notches which have a complementary configuration to the axle slots and the wheel and axle assemblies and are located such that when the retention member is in position to lock the wheel and axle assemblies in the axle slots the notches close off the axle slots.

8. The chassis assembly of claim 7 wherein the retention member includes a plurality of openings sized and located to allow free rotation of the wheels when the retention member is in position to lock the wheel and axle assemblies in the axle slots.

9. The chassis assembly of claim 1 further including a second retention member adapted to be releasably mounted adjacent the lower edges of the flanges to selectively lock a plurality of the wheel and axle assemblies in respective pairs of axle slots, the second retention member having a length sufficient to span a plurality of axle slots along a lower edges of the flanges and a width sufficient to span opposing pairs of axle slots, the second retention member including a central portion adapted to allow free rotation of the wheels when the second retention member is in position to lock the wheel and axle assemblies in the axle slots.

10. The chassis assembly of claim 9 wherein the first retention member and the second retention member are each pivotally connected to the channel member such that the first and second retention members can each pivot between an open position for the selective insertion and/or removal of the wheel and axle assemblies from respective pairs of axle slots and a closed position wherein the retaining member locks a plurality of the wheel and axle assemblies in respective pairs of axle slots.

11. A chassis assembly for an inline skate adapted to be mounted to a shoe and which allows for quick and easy rotation and replacement of the wheels of the skate, said chassis comprising:

an elongated channel member including a central portion adapted to be mounted to the shoe and a pair of flanges depending from the central portion which have lower longitudinal edges including a plurality of longitudinally spaced opposing pairs of axle slots;

a plurality of preassembled wheel and axle assemblies, each preassembled wheel and axle assembly comprising a wheel arranged between the flanges of the channel member and rotatably supported on an axle, the axle having a wheel mount at each end which is adapted to be retained in and engage a respective one of the axle slots such that the entire preassembled wheel and axle assembly can be selectively removed from the chassis by sliding the assembly downwardly relative to the channel member by hand, a selectively releasable retention member secured adjacent the lower edges of the channel member flanges and adapted to engage the plurality of wheel mounts and close off the opposing pairs of axle slots so as to prevent movement of the wheel mounts relative to the axle slots, and means for releasably securing the retention member to the channel member which is operable with human fingers without any need for any auxiliary tools.

12. The chassis assembly of claim 11 wherein the means for releasably securing the retention member to the channel member includes a hand operable screw.

13. The chassis assembly of claim 11 wherein the means for releasably securing the retention member to the channel member includes at least one detent on the retention member which engages a complementary detent opening on the channel member.

14. The chassis assembly of claim 11 the retention member is pivotally connected to the channel member such that it can pivot between an open position for selective insertion and/or removal of the preassembled wheel and axle assemblies from respective pairs of axle slots and a closed position wherein the retaining member locks a plurality of the preassembled wheel and axle assemblies in respective pairs of axle slots.

15. The chassis assembly of claim 14 wherein the means for releasably securing the retention member to the channel member includes a hand operable screw.

16. The chassis assembly of claim 14 wherein the means for releasably securing the retention member to the channel member includes at least one detent on the retention member which engages a complementary detent opening on the channel member.

17. The chassis assembly of claim of claim 11 wherein the retention member includes a pair of opposing upstanding flanges having a plurality of opposing longitudinally spaced notches which have a complementary configuration to the axle slots and the wheel mounts and are located such that when the retention member is in position to lock the wheel assemblies the notches engage the wheel mounts and close off the axle slots.

18. The chassis assembly of claim 17 wherein the retention member includes a plurality of openings sized and located to allow free rotation of the wheels when the retention member is in position to lock the preassembled wheel and axle assemblies in the axle slots.

19. The chassis assembly of claim 11 further including a second retention member adapted to be releasably mounted adjacent the lower edges of the flanges to selectively lock a plurality of the preassembled wheel and axle assemblies in respective pairs of axle slots, the second retention member having a length sufficient to span a plurality of axle slots along a lower edges of the flanges and a width sufficient to span opposing pairs of axle slots, the second retention member including a central portion adapted to allow free rotation of the wheels when the second retention member is in position to lock the preassembled wheel and axle assemblies in the axle slots.

20. The chassis assembly of claim 19 wherein the first retention member and the second retention member are each pivotally connected to the channel member such that the first and second retention members can each pivot between an open position for selective insertion and/or removal of the preassembled wheel and axle assemblies from respective pairs of axle slots and a closed position wherein the retaining member locks a plurality of the preassembled wheel and axle assemblies in respective pairs of axle slots.

21. The chassis assembly of claim 11 wherein each of the wheel mounts include a central boss and pair of flanges on opposing ends of the boss which define a groove which engages the axle slot to prevent movement of the wheel mounts in the axial direction of the wheel.

22. The chassis assembly of claim 11 wherein the wheel mounts have a central axis and said axle is offset from the wheel mount central axis such that position of the wheel relative to the channel member can be selectively varied.

23. The chassis assembly of claim 22 wherein the wheel mounts have an elongated configuration with opposing ends and the axle is adjacent one of the opposing ends such that position of the wheel relative to the channel member can be selectively varied.

24. The chassis assembly of claim 22 wherein the wheel mounts have a generally rectangular shape and the axle is adjacent one of the corners of the wheel mounts such that position of the wheel relative to the channel member can be selectively varied.

25. The chassis assembly of claim 22 wherein the wheel mounts have a generally triangular configuration such that position of the wheel relative to the channel member can be selectively varied.

26. The chassis assembly of claim 11 wherein each wheel assembly further includes a bushing which rotatably supports the wheel on the axle.

* * * * *